United States Patent [19]

Rieseck

[11] Patent Number: 4,989,634

[45] Date of Patent: Feb. 5, 1991

[54] FUEL DISPENSER CATCHMENT BOX

[75] Inventor: Raymond J. Rieseck, Beaver Falls, Pa.

[73] Assignee: Morgan Brothers Company, Beaver Falls, Pa.

[21] Appl. No.: 525,130

[22] Filed: May 17, 1990

[51] Int. Cl.[5] ..... H65B 1/04

[52] U.S. Cl. ..... 137/363; 137/312; 137/234.6; 248/694

[58] Field of Search ..... 137/363, 312, 234.6; 248/694, 57, 346; 405/52

[56] References Cited

U.S. PATENT DOCUMENTS

| | | | |
|---|---|---|---|
| 2,182,126 | 12/1939 | Hogarth | 221/95 |
| 2,959,826 | 11/1960 | Larsen et al. | 20/8 |
| 3,353,770 | 11/1967 | Sondheim | 248/694 |
| 4,617,975 | 10/1986 | Rabushka et al. | 141/311 |
| 4,762,440 | 8/1988 | Argandona | 137/363 |
| 4,842,443 | 6/1989 | Argandona | 137/363 |

*Primary Examiner*—A. Michael Chambers

*Attorney, Agent, or Firm*—Parmelee, Miller, Welsh & Kratz

[57] ABSTRACT

A fuel dispenser catchment box has a metal casing with an outwardly extending flange for attaching a dispenser housing and an inwardly extending flange for supporting a non-metallic closure member to close the bottom thereof. The closure member is removable and has apertures and seals for entry into the casing of a fuel supply line and an auxiliary line. The seals contain any fuel spillage in the closure member and prevent contamination of the ground, while removal of the closure member enables inspection of the fuel supply line beneath the fuel dispenser catchment box when necessary. A support clamp stabilizes the fuel supply line and an attached shut-off valve.

8 Claims, 2 Drawing Sheets

FUEL DISPENSER CATCHMENT BOX

FIELD OF THE INVENTION

The present invention relates to a fuel dispenser catchment box, such as the type of box apparatus positioned in the ground beneath a fuel dispenser cabinet, and specifically to such a box that is closed and sealed at the bottom to prevent ground contamination.

BACKGROUND OF THE INVENTION

Gasoline dispensers, or gasoline pumps, as referred to by the general public, are common features at service stations for dispensing gasoline, diesel fuel, or the like. While commonly called "pumps", because these originally were cabinets containing individual pumps for the dispensing of gasoline, this term is now a misnomer, since generally a single separate pump is used to transfer gasoline from a storage tank to a number of dispensers. The dispenser housings themselves, thus, only contain components for feeding gasoline from a supply conduit to a dispensing hose and nozzle, and certain auxiliary equipment, such as electronic metering and pricing equipment. Gasoline dispenser housings are normally set in place on a pump box, which is in the form of a metal frame, disposed in the ground, either flush with the concrete surface of a service station or flush with the concrete surface of an island built in the service station area, the metal frame, open at the top and bottom with a support in the frame to hold a safety valve that is connected at one end to a fuel line, and at the other end to the dispenser. One type of metal frame, or pump box, is illustrated in U.S. Pat. No. 3,353,770, which pump box is a generally rectangular housing, open at both the top and bottom and has four walls with flanges on two of the walls to support the box in a framework. A layer of course ground or stone is usually provided beneath the pump box and concrete poured around the box to enclose the same. Any gasoline that might spill from the dispenser conduit, in the case of a mishap, would thus drain into the ground or other earthen material below a conventional pump box.

With the advent of more stringent environmental regulations, it is important to attempt to contain any gasoline spillage and prevent passage of such spillage to the ground, where absorption could require removal and treatment of the contaminated ground material.

SUMMARY OF THE INVENTION

A fuel dispenser catchment box has a metal casing that is formed from opposed side walls and end walls with an open top and bottom, with an outwardly extending flange about the casing spaced from the open top, and a horizontally inwardly extending flange about the open bottom thereof. A non-metallic closure member is provided that has a base, opposed side walls and end walls and an open top, the closure member having an outwardly extending lip about the open top, which is arranged to rest on the inwardly directed flange of the metal casing so as to support the closure member in the casing, which closure member is removeable therefrom. The closure member has at least one fuel supply line aperture and at least one auxiliary conduit aperture formed in the base and a first seal is provided between the fuel line supply line and cooperating aperture and a second seal is provided between the auxiliary conduit and cooperating aperture.

The first seal between the fuel supply line and its aperture through the base of the closure member is preferably a compression seal in the form of a washer, a fiberglass pipe inserted through the compression washer, through which the fuel supply line extends upwardly into the interior of the metal casing, and a shrink-wrap seal closing the gap between the fuel supply line and the fiberglass tube.

A support clamp extends between the spaced side walls of the metal casing to support and stabilize the fuel supply line, and a shut-off valve is connected to the fuel supply line above the support clamp.

BRIEF DESCRIPTION OF THE DRAWINGS

The invention will become more readily apparent from the following description of a preferred embodiment thereof, shown by way of example only, in the accompanying drawings, wherein.

DETAILED DESCRIPTION

The present fuel dispenser box provides a means of containing any gasoline spillage from a shut-off valve or fuel supply line in a fuel dispenser, while preventing leakage of external water or other liquid to the box. The box has a removeable closure member in the bottom, that enables removal thereof and examination of the fuel supply line below the box to determine whether the line is still secure after damage to the dispenser.

Figure 2:
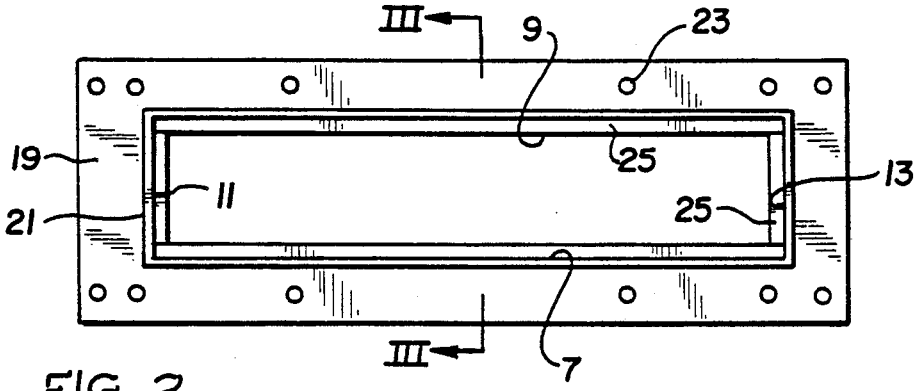
FIG. 2 is a plan view of the metal casing portion of the fuel dispenser catchment box.
Figure 3:
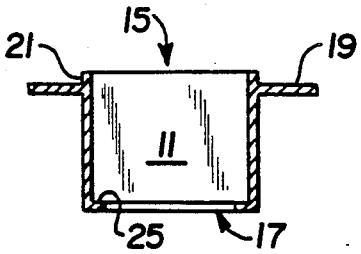
FIG. 3 is a view taken along lines III—III of FIG. 2.

Referring now to the drawings, the fuel dispenser catchment box 1 of the present invention is illustrated, having a metal casing 3, preferably of steel, and a non-metallic closure member 5, preferably of fiberglass, nylon, or the like. The metal casing 3, illustrated in detail in FIGS. 2 and 3, is formed from spaced side walls 7 and 9 and spaced end walls 11 and 13 connected to the side walls. The metal casing has an open top 15 and open bottom 17. On the outer surface of the metal casing 3, there is a means for attachment of a dispenser housing h to the casing, illustrated as a horizontally outwardly extending flange 19, preferably extending completely around the metal casing 3, and spaced from the open top 15 of the casing, so as to provide a ridge 21 or portion of the side walls 7 and 9 and end walls 11 and 13 about the metal casing above the flange 19. A plurality of apertures 23 are formed through the flange 19. Adjacent the open bottom 17 of the metal casing 3, there is provided a horizontally inwardly extending flange 25, which flange 25 preferably extends completely around the metal casing 3.

Figure 1:
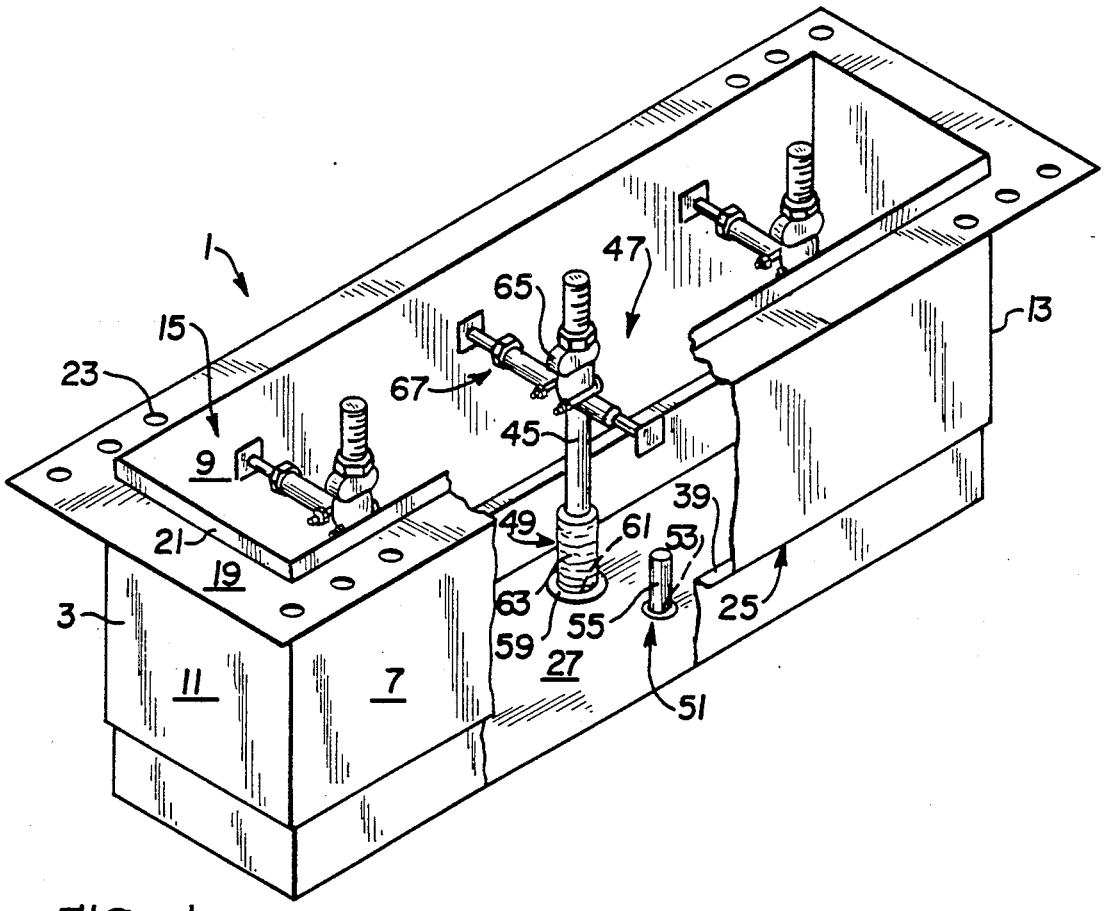
FIG. 1 is a perspective view of the fuel dispenser catchment box of the present invention with a portion cut away to show interior elements.
Figure 4:
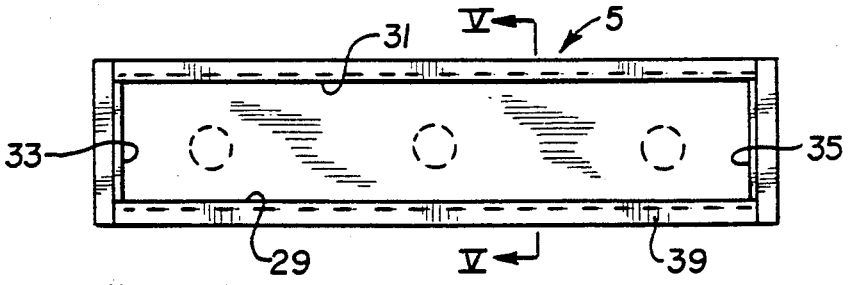
FIG. 4 is a plan view of the closure member portion of the fuel dispenser catchment box.
Figure 5:
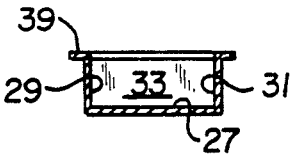
FIG. 5 is a view taken along lines V—V of FIG. 4.

The non-metallic closure member 5, as illustrated in detail in FIGS. 4 and 5, has a base 27, upwardly extending spaced side walls 29 and 31, and spaced end walls 33 and 35, with an open top 37. The closure member 5 has an outwardly extending lip 39, adjacent the open top 37 thereof. The lip 39 is of a size and shape that the closure member 5 can be inserted through the open top 15 of the metal casing 3, and the lip 39 will seat on the horizontally inwardly extending flange 25, with side walls 29, 31, end walls 33, 35 and base 27 of the closure member supported thereby, as shown in FIGS. 1 and 6.

The closure member 5 has at least one fuel supply line aperture 41 formed in the base 27, the base forming a wall 43 about the aperture 41, for entry from below of a fuel supply line 45 into the interior 47 of the metal frame 3, when the closure member 5 is positioned therein. A first seal 49 is used to seal any opening between the fuel supply line 45 and the wall 43 about aperture 41.

The closure member 5 also has at least one auxiliary conduit aperture 51, formed in the base 27, the base forming a wall 53, about the aperture 51, for entry from below of an auxiliary conduit 55 into the interior 47 of the metal frame 3, and a second seal 57 is used to seal any opening between the auxiliary conduit 55 and the wall 53 about aperture 51.

Figure 6:
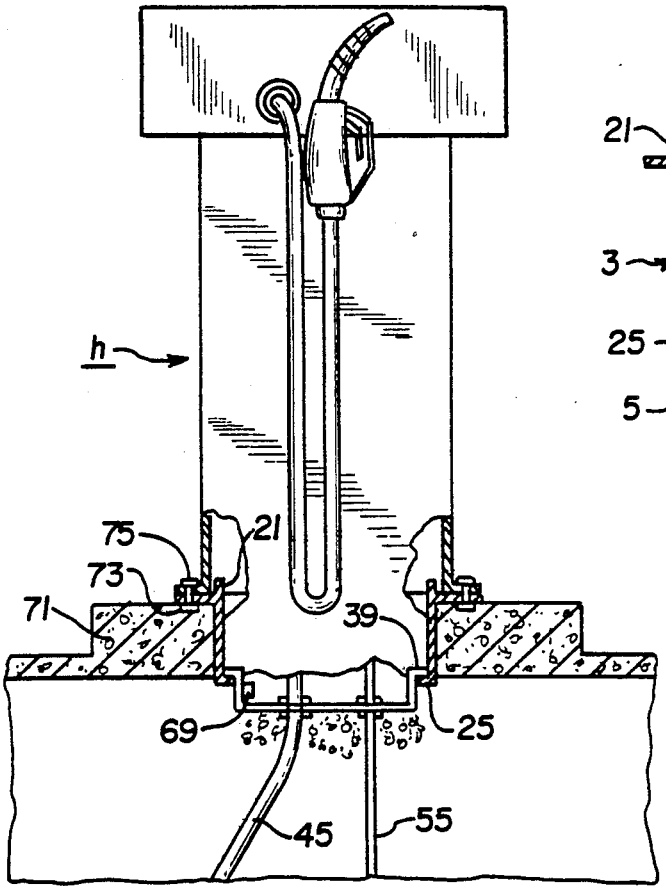
FIG. 6 is an exploded perspective view through the fuel dispenser catchment box showing the seals between a fuel supply line and an auxiliary conduit and the base of the closure member.

A preferred seal 49 for use with the fuel supply line 45, as illustrated in FIG. 6 includes a compression type pipe-to-tank seal, such as that sold by Topp Industries, Inc., of Rochester, IN, under the name "UNISEAL". This seal includes a flanged washer-like member 59, which is forced into sealing engagement with the walls 43 of aperture 41. A short section of fiberglass tubing 61 is then inserted through the washer and compresses the same, the fiberglass tubing 61 in sealing engagement with the inner wall of said washer. The fuel supply line 45, of an outer diameter less than inner diameter of the fiberglass tubing 61, is passed upwardly through the fiberglass tubing and a shrink sleeve 63, such an elastomer tubing with adhesive, sold by Austin Engineering Corporation of Barberton, Ohio, is disposed over a portion of the fiberglass tubing 61 and the adjacent portion of the fuel supply line 45 and shrunk by application of heat to seal those two elements. A shut-off valve 65 is then connected to the end of fuel supply line 45.

Extending between the spaced side walls 7 and 9 of the metal frame 3, adjacently above each fuel line aperture 41 is a support clamp 67, which is used to support and stabilize the fuel supply line 45 that extends into the interior 47 of the metal frame 3. The inlet of the safety or shut-off valve 65, as is conventional, is connected to the end of the fuel supply line from an underground gasoline storage facility, and the outlet is connected to the fuel dispensing unit. This shut-off valve 65 stops the flow of fuel from the storage tank to the dispenser unit, if the dispenser housing is impacted or overturned, or when excessive heat from a fire on or near the island is present. A variety of such shut-off valves are commercially available, an example of which is the OPW 10-R Series Emergency Valve sold by Dover Corporation of Cincinnati, Ohio.

In order to use the present invention dispenser catchment box 1, the components are provided at the dispenser site and the metal casing 3 set in the area of a dispenser island at the desired location. The metal casing is preferably formed from steel, the side and end walls being of about ⅛" thickness and the depth below the horizontal flange 19 being about 8'. The actual dimension will, however, of course, vary depending upon the intended use. A non-metallic closure member 5, having a closed bottom is inserted into the steel casing 3, such that the outwardly extending lip 39 seats on its horizontally inwardly extending flange 25, of the steel casing, to support the closure member 5 on the metal casing 3. If desired, a sealant may be provided about the rim of the lip 39 and the flange 25 to seal the area of contact between these two components. The closure member 5 will preferably have markings for the location of the fuel supply line 45 and auxiliary conduit 55 and the apertures 41 and 51 are formed in the base 27. For a 1.5 inch fuel supply line, an aperture 41 of a diameter of about 4" could be cut in the base 27, while an aperture 51 of about 1.75 inches would be cut for the auxiliary conduit 55. A compression-type washer 59, having an inner diameter of about 3.25 to 3.75 inches, and the outer diameter that will compressibly seal with the wall 43 of aperture 41, is engaged with the wall 43 about aperture 41. A 3.25 inch outer diameter fiberglass hollow tube 61, having an inner diameter greater than the outer diameter of the fuel supply line, approximately 3.3125 inch, is inserted through and secured in the washer 59. A second seal, 57 in the form of a compression-type washer, is also engaged in the auxiliary conduit aperture 51 and the auxiliary conduit 55 having an outer diameter corresponding to one which will sealingly engage the inner diameter of the washer forced through the washer to provide the seal 57. The fuel supply line 45, generally about 1.5 inches in diameter, is then passed upwardly through the fiberglass tubing 61. A shrink sleeve 63 is placed over a portion of the supply line conduit 45 and a portion of the fiberglass tubing 6!. The shut-off valve 65 is attached to the end of the fuel supply line 45 and the support clamp 67, affixed thereto, and the support clamp 67 attached to the side walls 7, 9 of the metal casing 3. When the fuel supply line 45 is stabilized, the shrink sleeve 63 is heated at the end portions to shrink and seal the same to the fuel supply line 45 and fiberglass tubing 61 to provide a seal therebetween. A hydrocarbon monitor 69 (FIG. 7) is preferably installed in the fuel dispenser containment box. The fuel dispenser catchment box may be designed to accommodate one, two, or more fuel supply lines and auxiliary conduits depending upon the needs of the user.

Figure 7:
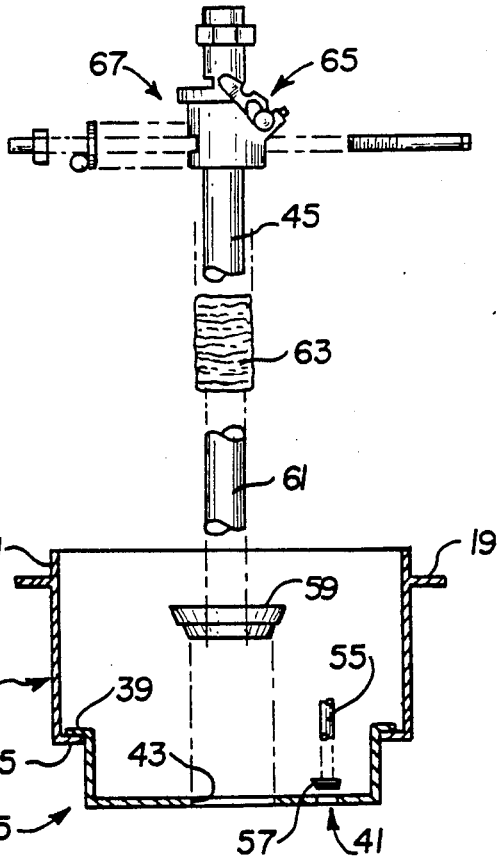
FIG. 7 is a view, partially in section, showing a dispenser housing attached to a fuel dispenser catchment box arranged in a service station island.

After placement and assembly of the fuel dispenser catchment box I in the selected area, the concrete driveway or island 71 is poured, with the concrete island reaching to the horizontally outwardly extending flange 19, as illustrated in FIG. 7. The fuel dispenser housing h is then secured to the fuel dispenser catchment box 1, such as by means of bolts 73 embedded in the concrete, the bolts 73 extending upwardly through the apertures 23 in horizontally outwardly extending flange 19 and cooperating bores through the housing h, and nuts 75 used to secure the same.

The present fuel dispenser catchment box may also be used with secondary containment systems where a second conduit or sleeve surrounds the supply line 45. In that embodiment, the fiberglass tubing 61 would extend below the base 27 of the non-metallic closure member 5 and the second conduit sealed to the exposed bottom end of the fiberglass tubing.

The ridge 21 on the metal casing 3 prevents water or other liquid, which may be on the island 71, from entering into the interior 47 of the metal housing 3. In the event of an impact or other mishap, any spillage of fuel from the fuel supply line 45, prior to stoppage of flow by the shut-off valve 65, will flow to the base 29 of the closure member 5 and be retained within the closure member 5 by seals 49 and 57, which retained fuel can be removed and properly disposed of. Contamination of the ground beneath the fuel catchment box 1 is thus prevented. Also, in the case of an impact to the system, the user may check the condition of the fuel supply line 45 beneath the fuel dispenser catchment box 1 by shutting off the flow of fuel, removing the shut-off valve 65 and support clamp 67, and lifting the closure member 5 from the metal casing 3 to expose the area beneath the fuel dispenser catchment box 1. The system may then be reassembled after any repairs or replacements, if necessary.

What is claimed is:

1. A fuel dispenser catchment box comprising:

a metal casing, formed from spaced side walls and end walls, having an open top and open bottom;

means on the outer surface of said metal casing, spaced from said open top, for attachment of a dispenser housing;

a horizontally inwardly extending flange on said metal casing about the open bottom thereof;

a non-metallic closure member having a base, upwardly extending spaced side walls and end walls and an open top, said closure member having an outwardly extending lip about the open top thereof which rests on the horizontally inwardly extending flange of said metal casing to close the bottom of said casing;

at least one fuel supply line aperture, having a wall, formed in the base of said closure member for entry to said metal casing of a fuel supply line thereto;

a first seal between said fuel supply line and the wall of said fuel supply line aperture;

at least one auxiliary conduit aperture, having a wall, formed in the base of said closure member for entry to said metal casing of an auxiliary conduit thereto;

a second seal between said auxiliary conduit and the wall of said auxiliary conduit aperture, and a support clamp extending between the spaced walls of said metal casing adjacently above said fuel supply line aperture for support of a fuel supply line therein.

2. The gasoline dispenser catchment box as defined in claim wherein said means for attaching the dispenser housing comprises a horizontally outwardly extending flange on said metal casing spaced from the open top thereof.

3. The fuel dispenser catchment box as defined in claim 1, wherein said first seal comprises a compression washer seal in sealing engagement with the wall about said fuel supply line aperture, a fiberglass tubing, extended through and in sealing engagement with the inner wall of said washer, and means for sealing the gap between a fuel supply line extending upwardly through said fiberglass tubing and said fuel supply line.

4. The fuel dispenser catchment box as defined in claim 3, wherein said means for sealing the gap between said fuel supply line and said fiberglass tubing is a shrink sleeve, shrinkable by application of heat.

5. The fuel dispenser catchment box as defined in claim 1, wherein said second seal comprises a compression washer seal in sealing engagement with the wall about said auxiliary conduit aperture and an auxiliary conduit extending through and in sealing engagement with the inner wall of said washer.

6. A fuel dispenser catchment box comprising:

a metal casing, formed from spaced side walls and end walls, having an open top and open bottom;

a horizontally outwardly extending flange on the outer surface of said metal casing, spaced from said open top, for attachment of a dispenser housing;

a horizontally inwardly extending flange on said metal casing about the open bottom thereof;

a non-metallic closure member having a base, upwardly extending spaced side walls and end walls and an open top, said closure member having an outwardly extending lip about the open top thereof which rests on the horizontally inwardly extending flange of said metal casing to close the bottom of said casing;

at least one fuel supply line aperture, having a wall, formed in the base of said closure member for entry to said metal casing of a fuel supply line thereto;

a first seal, including a compression washer seal in sealing engagement with the wall about said fuel supply line aperture, a fiberglass tubing, extended through and in sealing engagement with the inner wall of said washer, and means for sealing the gap between a fuel supply line extending upwardly through said fiberglass tubing and said fuel supply line;

at least one auxiliary conduit aperture, having a wall, formed in the base of said closure member for entry to said metal casing of an auxiliary conduit thereto;

a second seal between said auxiliary conduit and the wall of said auxiliary conduit aperture, and a support clamp extending between the spaced walls of said metal casing adjacently above said fuel supply line aperture for support of a fuel supply line therein.

7. The fuel dispenser catchment box as defined in claim 6, wherein said means for sealing the gap between said fuel supply line and said fiberglass tubing is a shrink sleeve, shrinkable by application of heat.

8. The fuel dispenser catchment box as defined in claim 7, wherein said second seal comprises a compression washer seal in sealing engagement with the wall about said auxiliary conduit aperture and an auxiliary conduit extending through and in sealing engagement with the inner wall of said washer.

* * * * *